US007849719B2

(12) United States Patent
Chern

(10) Patent No.: US 7,849,719 B2
(45) Date of Patent: Dec. 14, 2010

(54) LOCKING DEVICE

(76) Inventor: Der-Yuh Chern, No. 18, Lane 91, Kuei Jen Rd., Pintung (TW)

( * ) Notice: Subject to any disclaimer, the term of this patent is extended or adjusted under 35 U.S.C. 154(b) by 90 days.

(21) Appl. No.: 12/402,515

(22) Filed: Mar. 12, 2009

(65) Prior Publication Data

US 2009/0241612 A1 Oct. 1, 2009

Related U.S. Application Data

(63) Continuation-in-part of application No. 12/057,386, filed on Mar. 28, 2008, now abandoned.

(51) Int. Cl.
*E05B 65/06* (2006.01)

(52) U.S. Cl. ..... 70/104; 70/106; 70/107; 70/129; 70/134; 70/DIG. 52; 292/140; 292/143

(58) Field of Classification Search ..... 70/134, 70/106–111, 104, 129, DIG. 52, DIG. 54; 292/140, 143

See application file for complete search history.

(56) References Cited

U.S. PATENT DOCUMENTS

| | | | | |
|---|---|---|---|---|
| 347,414 | A * | 8/1886 | Alvord | 70/492 |
| 448,912 | A * | 3/1891 | Deny | 70/134 |
| 460,498 | A * | 9/1891 | Berry | 70/134 |
| 471,595 | A * | 3/1892 | Arens | 70/134 |
| 1,799,503 | A * | 4/1931 | Devereaux | 292/169 |
| 2,963,897 | A * | 12/1960 | Dupere | 70/447 |
| 4,248,068 | A * | 2/1981 | Esser et al. | 70/134 |
| 6,354,121 | B1 * | 3/2002 | Frolov | 70/277 |
| 6,851,287 | B1 * | 2/2005 | Yang et al. | 70/107 |
| 6,928,844 | B2 * | 8/2005 | Chiang et al. | 70/109 |
| 7,377,076 | B2 * | 5/2008 | Shedd | 49/449 |
| 2006/0185405 | A1 * | 8/2006 | Middleton | 70/134 |
| 2007/0199354 | A1 * | 8/2007 | Ellis | 70/134 |

* cited by examiner

*Primary Examiner*—Lloyd A Gall
(74) *Attorney, Agent, or Firm*—Leong C. Lei

(57) ABSTRACT

The locking device contains an axle, a bolt, a positioning plate, and a cylinder. The axle is connected to a thumb-turn knob and, from a circumference of the axle, a lever is extended perpendicularly. The bolt has a vertical trough in a rear section. An end of the lever is embedded in the trough. The positioning plate has an elongated opening inside which the axle is embedded. The cylinder is positioned adjacent to and above the rear section of the bolt. The cylinder has a key hole in the center and an activation bar extended from a circumference of the cylinder. When the thumb-turn knob or a key in the key hole is turned, the positioning plate is moved towards an opposite direction. In turn, the lever of the axle pushes or pulls the bolt in the same directions as the key or the knob is turned.

3 Claims, 7 Drawing Sheets

LOCKING DEVICE

CROSS-REFERENCE TO RELATED APPLICATION

This is a continuation-in-part of the co-pending patent application Ser. No. 12/057,386, filed Mar. 28, 2008, now abandoned.

(a) TECHNICAL FIELD OF THE INVENTION

The present invention generally relates to locking devices, and more particularly to a locking device in which the bolt's protrusion and retraction are in the same directions as the engagement and disengagement of the locking device.

(b) DESCRIPTION OF THE PRIOR ART

Conventionally, there is a type of door locks whose inside cylinder and internal thumb-turn knob are turned in a direction opposite to that of the lock's bolt. In other words, when the door lock is engaged or disengaged, the bolt protrudes from the lock body into a door jamb or retracts into the lock body as the cylinder and the knob are turned towards an opposite direction.

This type of door locks, as their operation is somewhat counter-intuitive, usually would confuse the senior or young residents. This confusion could be disastrous when there is some emergency and people have to open the door and escape from the house as soon as possible.

SUMMARY OF THE INVENTION

The primary purpose of the present invention is to provide a novel locking device to obviate the foregoing shortcoming of conventional locking devices. According to the present invention, the protrusion and retraction of the bolt of the locking device is in the same directions as the key or the knob of the locking device is turned.

The locking device contains an axle, a bolt, a positioning plate, and a cylinder. The axle is connected to a thumb-turn knob and, from a circumference of the axle, a lever is extended perpendicularly. The bolt has a vertical trough in a rear section. An end of the lever is embedded in the trough. The positioning plate has an elongated opening inside which the axle is embedded. The cylinder is positioned adjacent to and above the rear section of the bolt. The cylinder has a key hole in the center and an activation bar extended from a circumference of the cylinder.

When the thumb-turn knob or a key in the key hole is turned, the positioning plate is moved towards an opposite direction. In turn, the axle is driven so that the lever of the axle pushes or pulls the bolt outside or inside of the locking device in the same directions as the key or the knob is turned.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
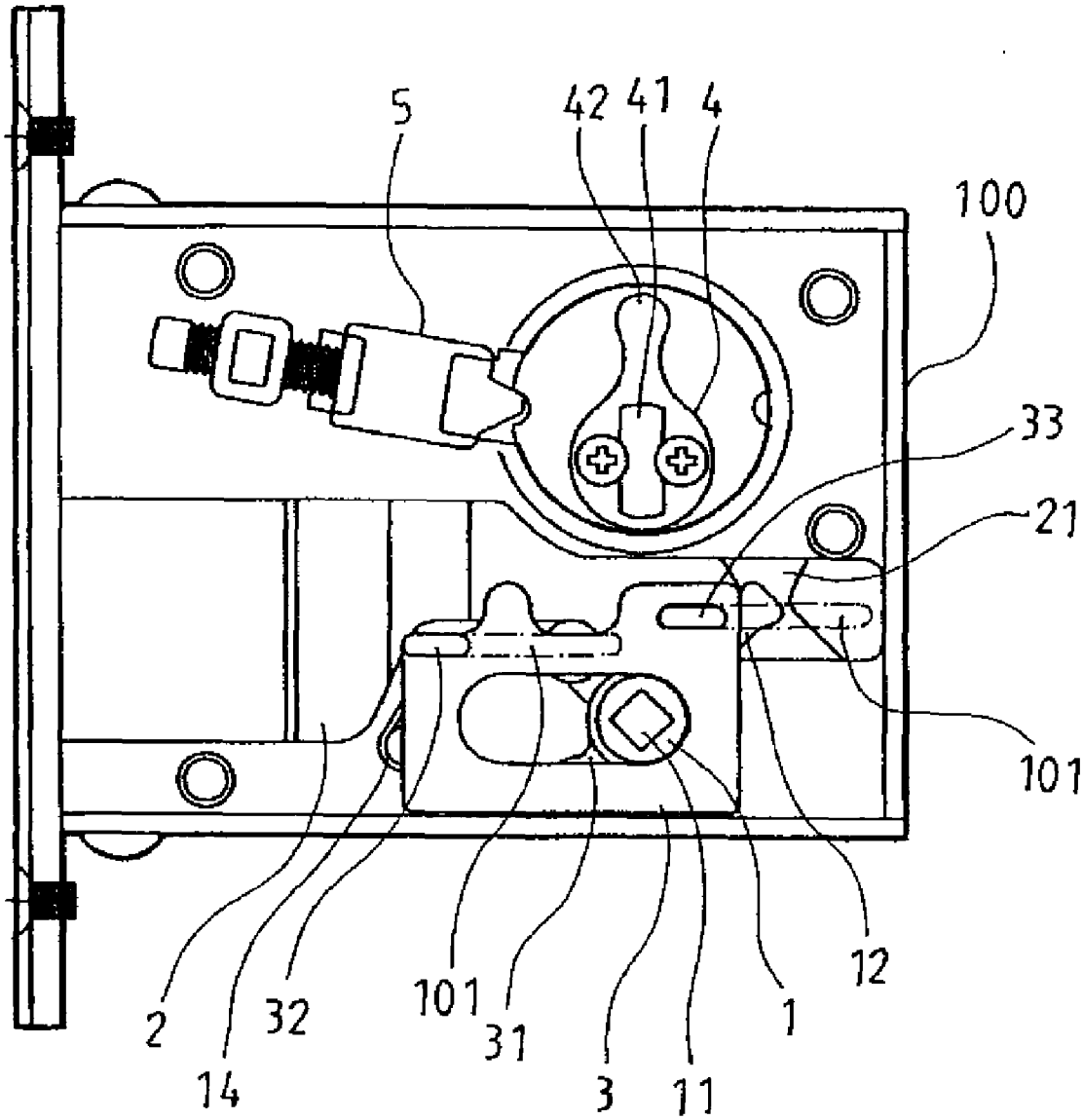
FIG. 1 is a sectional diagram showing a locking device according to an embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1, 2, 2A and 2B, a locking device according to an embodiment of the present invention mainly contains a housing 100 with two side casings (not shown) and, inside the space formed by the two side casings, an axle 1, a bolt 2, a positioning plate 3, a cylinder 4, and a latch 5. The axle 1 has an axial rectangular channel 11 for the installation of a thumb-turn knob (not shown) and, from a circumference of the axle 1, a lever 12, a pole 13 and a driving rod 10 are extended perpendicularly. The pole 13 is arranged between the lever 12 and the driving 10. The lever 12 and the pole 13 are orthogonal to each other, and the pole 13 and the driving rod 10 are orthogonal to each other. The pole 13 is engaged by an end of a torsion spring 14 which is fixed to one of the side casing of the housing 100.

The bolt 2 is positioned above the axle 1 and has a vertical trough 21 in a rear section of the bolt 2. The trough 21 is narrow in the middle and, from the middle, is gradually enlarged towards an upper end and a lower end of the trough 21. An end of the lever 12 distant from the axle 1 is embedded in the trough 21.

The positioning plate 3 has an elongated opening 31 inside which the axle 1 is embedded. The lever 12 and the pole 13 are therefore positioned at a side to the positioning plate 3. The positioning plate 3 also has two protrusions 32 and 33 on the other side of the plate 3 opposite to the lever 12 and the pole 13. The two protrusions 32 and 33 are embedded in two slots 101 on an inside surface of the other side casing of the housing 100. The rear side of the upper edge of the positioning plate 3 is provided with two guide rods 34 and 35, while the rear side of the lower edge of the positioning plate 3 has two engaging rods 36 and 37. The pushing rods 36 and 37 are disposed under the bolt 2. The driving rod 10 of the axle 1 is arranged between the two pushing rods 36 and 37 of the positioning plate 3.

The cylinder 4 is positioned adjacent to and above the rear section of the bolt 2. The cylinder 4 has a key hole 41 in the center and an activation bar 42 extended from a circumference of the cylinder 4.

The latch 5 is positioned at a side to the cylinder 4 for positioning the cylinder 4.

When a key inserted in the key hole 41 or a thumb-turn knob is turned, a positioning plate 3 is engaged and moved laterally to push or retrieve the bolt 2 out or inside. Most importantly, the protrusion and retraction of the bolt 2 is in the same directions as the key or the knob is turned.

Figure 2:
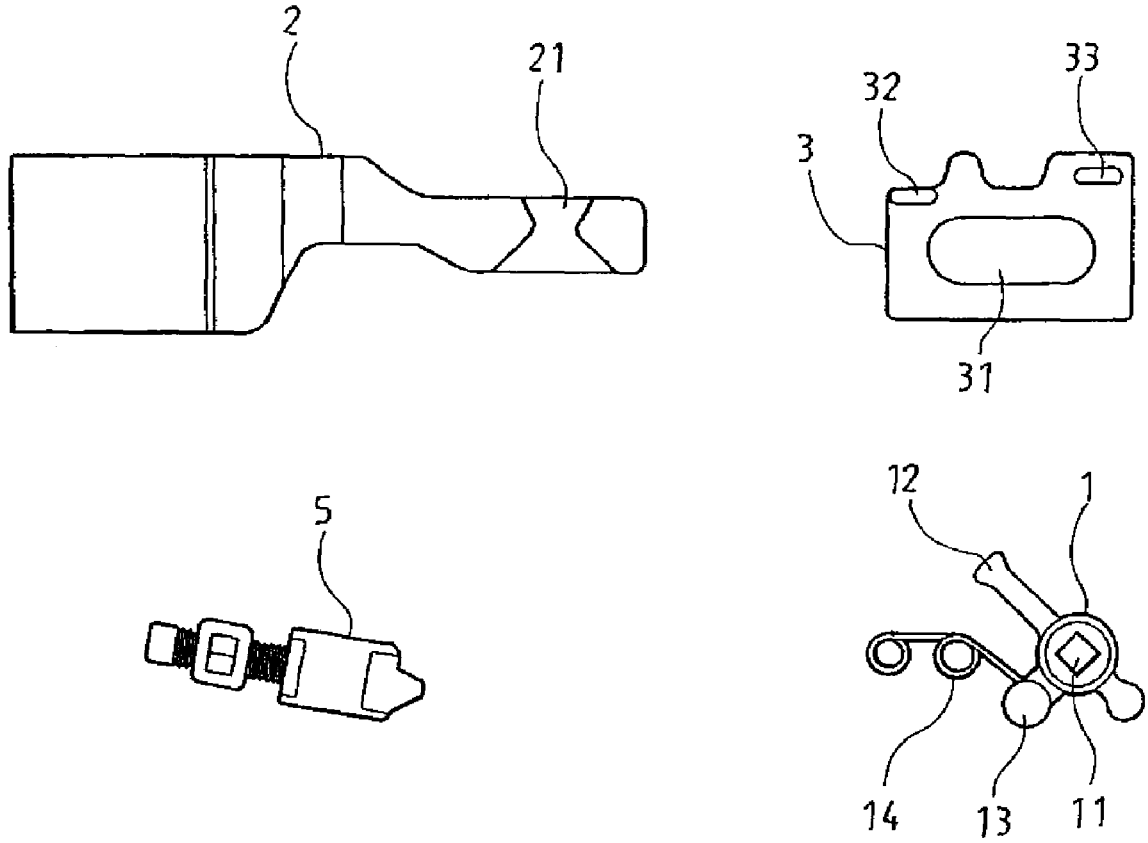
FIG. 2 is a side-view diagram showing a number of major parts of the locking device of FIG. 1.
Figure 2A:
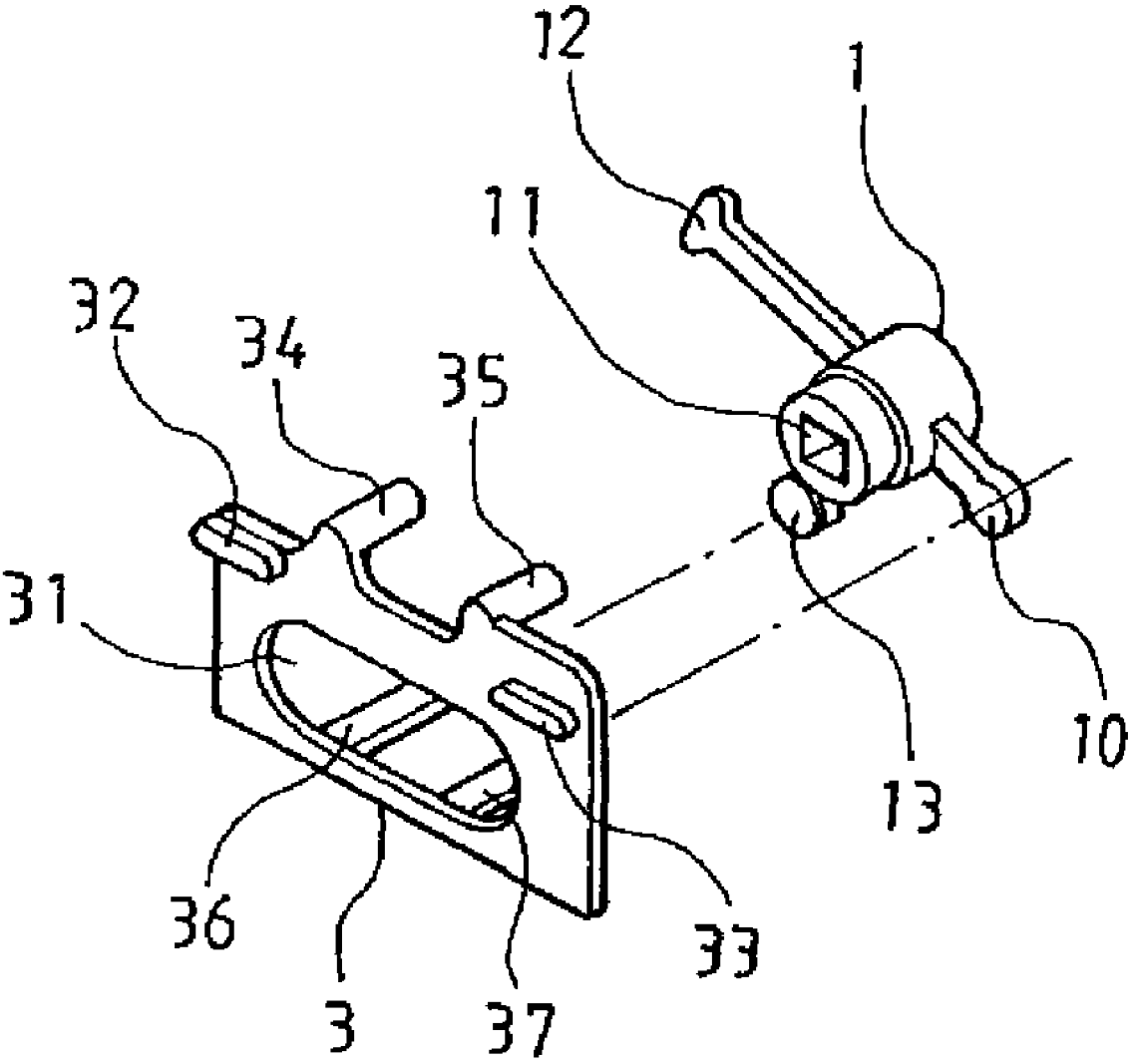
FIG. 2A is a perspective view showing the relationship between the axle and the positioning plate.
Figure 2B:
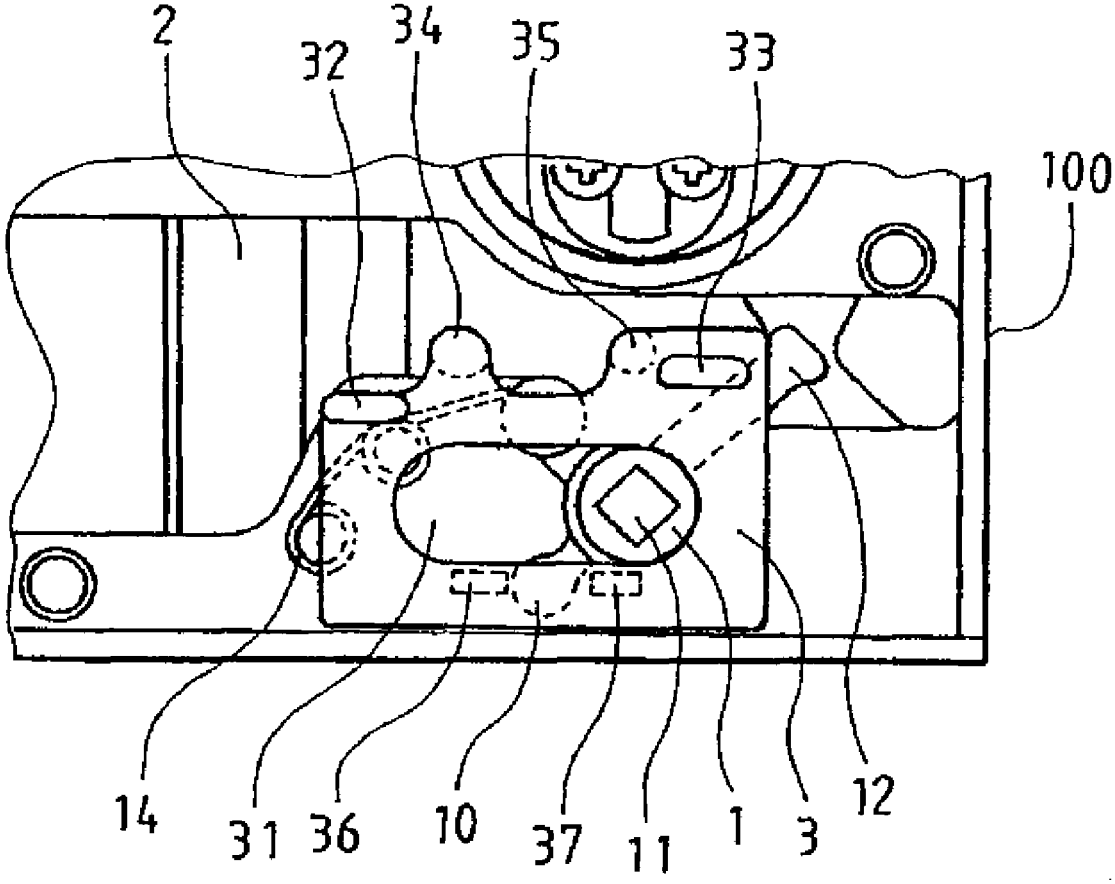
FIG. 2B is an enlarged view of a portion of FIG. 1.
Figure 3:
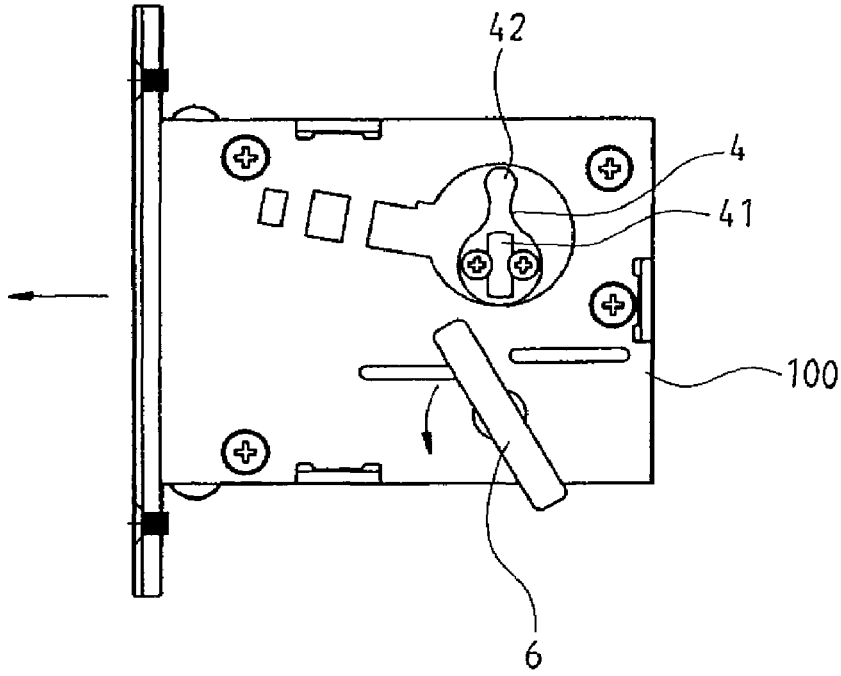
FIG. 3 is a side-view diagram showing a thumb-turn knob is turned to engage the locking device of FIG. 1.
Figure 5:
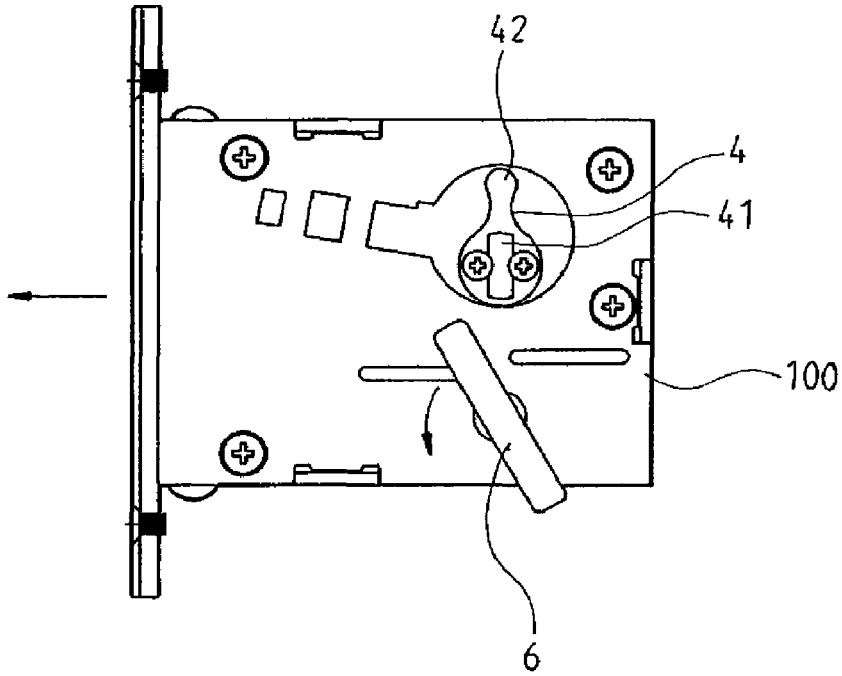
FIG. 5 is a sectional-view diagram showing a thumb-turn knob is turned to engage the locking device of FIG. 1.

As shown in FIGS. 2B, 3 and 5, when a thumb-turn knob 6 is turned outward (i.e., towards a door jamb into which the bolt 2 of the locking device protrudes), the axle 1 will be rotated counterclockwise thereby causing the driving rod 10 to push the pushing rods 36 and 37 of the positioning plate 3 inward (i.e. away from the door jamb). In the meantime, the lever 12 of the axle, through its embedment in the trough 21 of the bolt 2, pushes the bolt 2 outside of the housing 100. The door is thereby locked. When the positioning plate 3 is moved, as the protrusions 32 and 33 are confined by the slots 101, the positioning plate 3 is thereby limited to lateral movement only.

Figure 4:
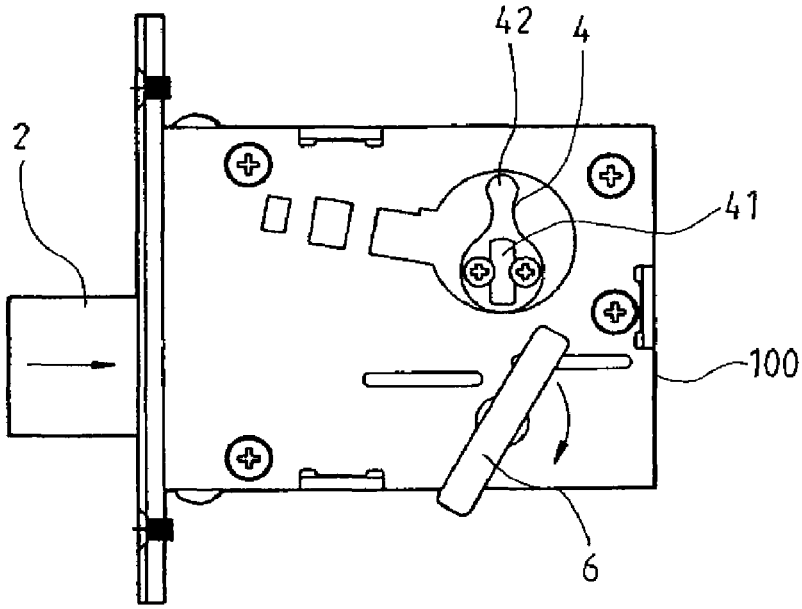
FIG. 4 is a side-view diagram showing a thumb-turn knob is turned to disengage the locking device of FIG. 1.
Figure 6:
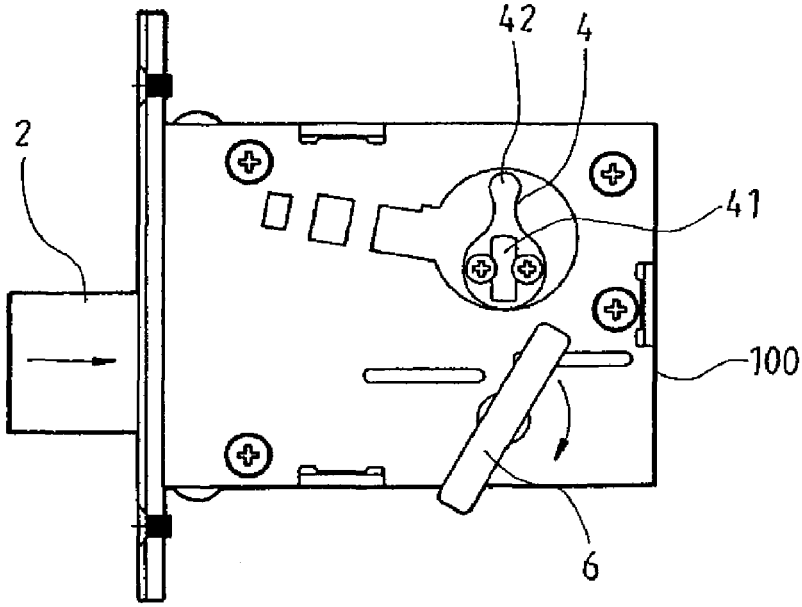
FIG. 6 is a sectional-view diagram showing a thumb-turn knob is turned to disengage the locking device of FIG. 1.

As shown in FIGS. 4 and 6, when a thumb-turn knob 6 is turned inward (i.e., away from the door jamb), the axle 1 will be rotated clockwise thereby causing the driving rod 10 to push the pushing rods 36 and 37 of the positioning plate 3 outward (i.e. toward the door jamb). In the meantime, the lever 12 of the axle, through its embedment in the trough 21 of the bolt 2, pulls the bolt 2 inside of the housing 100 and out of the door jamb. The door is thereby unlocked.

Figure 7:
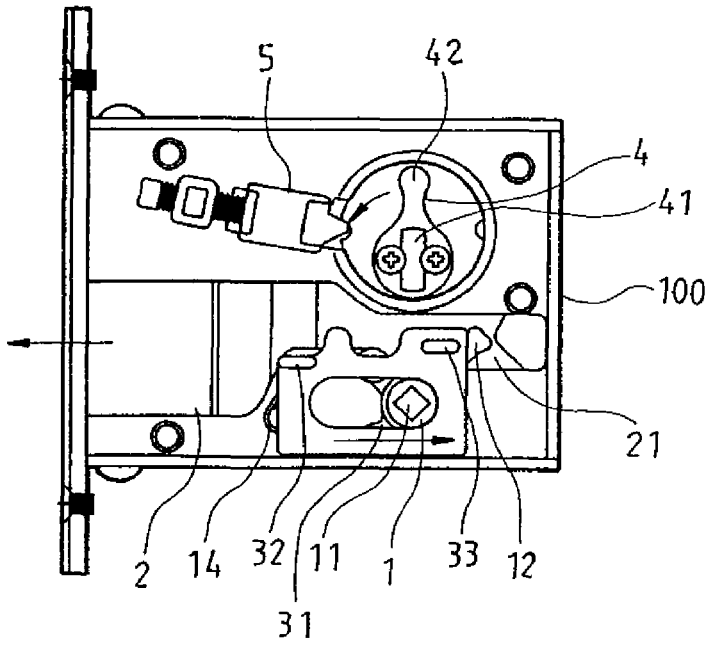
FIG. 7 is a sectional-view diagram showing a key is turned to engage the locking device of FIG. 1.

As shown in FIG. 7, when a key is inserted into the key hole 41 and turned outward, the activation bar 42 of the cylinder 4 moves the positioning plate 3 inward. Again, the axle 1 is turned and the lever 12 pushes the bolt 2 outside of the housing 100 and into the door jamb. The door is thereby locked.

Figure 8:
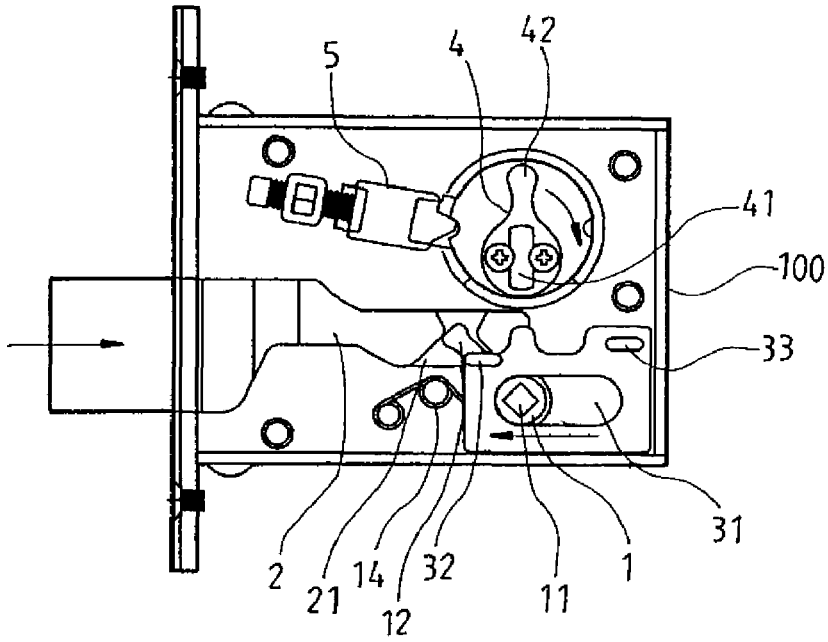
FIG. 8 is a sectional-view diagram showing a key is turned to disengage the locking device of FIG. 1.

As shown in FIG. 8, when the key in the key hole 41 is turned inward, the activation bar 42 of the cylinder 4 moves the positioning plate 3 outward. The axle 1 is turned and the lever 12 pulls the bolt 2 inside of the housing 100 and out of the door jamb. The door is thereby unlocked.

According to the foregoing description, the protrusion and retraction of the bolt 2 is in the same directions as the key or the knob is turned. This is more intuitive to users of all ages and therefore the locking device is more convenient and easy to use.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A locking device, comprising:

a housing;

an axle inside said housing having an axial channel for installing a knob, a lever, a driving rod and a pole, said lever and said pole extended orthogonally to each other from a circumference of said axle, said pole and said driving rod extended orthogonally to each other from a circumference of said axle;

a torsion spring inside said housing having an end connected to said pole;

a bolt inside said housing above said axle having a trough in a rear section of said bolt, an end of said lever distant from said axle being embedded in said trough;

a positioning plate inside said housing having an elongated opening inside which said axle is embedded, and two protrusions on a side of said positioning plate, said positioning plate having a lower edge provided with two pushing rods between which is arranged said driving rod of said axle;

a cylinder inside said housing adjacent to and above said rear section of said bolt having a key hole and an activation bar extended from a circumference of said cylinder; and a latch at a side to said cylinder for positioning said cylinder;

wherein, when a key inside said key hole or said knob is turned, said axle will be rotated thereby causing said driving rod to push said pushing rods of said positioning plate, and said lever of said axle, through embedment in said trough of said bolt, pushes said bolt outside or inside of said housing so that said lever pushes or pulls said bolt in the same directions as said key or said knob is turned.

2. The locking device according to claim 1, wherein said trough has a narrow middle section and, from said middle section, said trough is gradually enlarged towards an upper end and a lower end of said trough.

3. The locking device according to claim 1, wherein said two protrusions are embedded in two slots, respectively, on an inner surface of said housing.

* * * * *